US005467726A

United States Patent [19]

Hutchins

[11] Patent Number: 5,467,726

[45] Date of Patent: Nov. 21, 1995

[54] FURLING LINE TENSION CONTROL FOR ROLLER-REEFING DRUM

[76] Inventor: William L. Hutchins, 654 Harbor Island, Clearwater, Fla. 33515

[21] Appl. No.: 357,913

[22] Filed: Dec. 16, 1994

[51] Int. Cl.[6] ..... B63B 21/04

[52] U.S. Cl. ..... 114/218; 114/106

[58] Field of Search ..... 114/218, 392, 114/102, 104, 105, 106; 182/3; 24/602, 698

[56] References Cited

U.S. PATENT DOCUMENTS

| | | | |
|---|---|---|---|
| 3,730,129 | 5/1973 | Helms | 114/218 |
| 3,749,043 | 7/1973 | Crall | 114/106 |
| 3,750,611 | 8/1973 | Field | 114/218 |
| 3,795,218 | 3/1974 | Merry | 114/218 |
| 3,938,458 | 2/1976 | Irgens | 114/66.5 |
| 4,122,793 | 10/1978 | Molz | 114/106 |
| 4,217,847 | 8/1980 | McCloud | 114/218 |
| 4,240,369 | 12/1980 | Molz | 114/106 |
| 4,248,281 | 2/1981 | Hood | 114/106 |
| 4,348,974 | 9/1982 | Lerner | 114/218 |
| 4,620,499 | 11/1986 | Siemmons | 114/218 |
| 4,671,200 | 6/1987 | Nakamura | 114/106 |
| 4,723,499 | 2/1988 | Furgang | 114/106 |
| 4,873,934 | 10/1989 | Renault | 114/218 |

OTHER PUBLICATIONS

Harken 88, catalog, Pewaukee, Wisconsin, p. 86.

Article by Win Fowler entitled "Mastering the Roller–furling Headsail" published in Oct. 1994 at pp. 32 and 34 of Sail Magazine.

*Primary Examiner*—Stephen Avila

*Attorney, Agent, or Firm*—Richard G. Heywood

[57] ABSTRACT

A furling line tensioning device is provided to control the line coiling action of a roller-reefing drum, comprising a cam-type cleat having a sailboat mounting base, first and second cam members on the base and having opposed cam walls receiving a furling line therebetween, at least one cam member being movable and spring-biased toward a closed position to maintain a tensioning force on a furling line during its movement in one direction.

18 Claims, 4 Drawing Sheets

FURLING LINE TENSION CONTROL FOR ROLLER-REEFING DRUM

BACKGROUND OF THE INVENTION

1. Field of the Invention

The present invention relates generally to improvements in roller-reefing control devices for sailboats, and more particularly to a tensioning device for furling lines.

2. Description of the Prior Art

Over the years the need for effective furling and reefing systems for sailboats has been recognized, and it has become a usual practice to provide a roller mechanism for rotating a headstay to roll the jib or other foresail about its luff or leading edge to reduce or increase the effective sail area. Such systems are generally referred to as roller reefing or furling systems.

In past systems a drum or spool is mounted at the lower end of the forestay member to receive a furling line used to rotate the furling system. Examples of roller-reefing systems are disclosed in the following U.S. patents:

| U.S. Pat. No. | Inventor | Date |
|---|---|---|
| 3,749,043 | Crall | July 31, 1973 |
| 3,938,458 | Irgens | Feb. 17, 1976 |
| 4,122,793 | Molz | Oct. 31, 1978 |
| 4,240,369 | Molz | Dec. 23, 1980 |
| 4,248,281 | Hood | Feb. 3, 1981 |
| 4,671,200 | Nakamura | June 9, 1987 |
| 4,723,499 | Furgang | Feb. 9, 1988 |

Typically, a furling line is tethered to the drum in a roller-reefing system and extends to the cockpit for manual control by the sailor. When the jib or foresail is to be unfurled or reefed, the jib line (and furling line) is uncleated at the cockpit and used to start unfurling the sail, and the wind force then can act on the sail to bring about the unfurling action. In this process the furling line is coiled onto the drum as it rotates with the headstay.

A principal problem in the past has been that the furling line usually does not coil smoothly and evenly onto the drum and sometimes becomes looped and snagged, but even if not, the sloppy or unkempt appearance is an eyesore and out of keeping with the usual orderliness of a sailing vessel.

Also known in the prior art are cam cleat devices for releasably gripping ropes to permit movement in one direction but prevent any movement in the opposite direction. Examples of such cam cleat devices are disclosed in the following U.S. patents:

| U.S. Pat. No. | Inventor | Date |
|---|---|---|
| 3,730,129 | Helms | May 1, 1973 |
| 3,750,611 | Field | Aug. 7, 1973 |
| 4,217,847 | McCloud | Aug. 19, 1980 |

SUMMARY OF THE INVENTION

The present invention is embodied in a furling line tensioning device for controlling the coiling action on a roller-reefing drum, and comprises a cam-type pressure means having relatively smooth opposed cam surfaces biased toward each other and tensioning a furling line therebetween while permitting passage of the furling line in opposite linear directions.

A principal object of the invention is to provide means for maintaining a furling line under tension during unfurling or reefing operation.

Another object is to control the furling and reefing of sails from the cockpit and maintain the orderly coiling of the furling line on its drum.

Another object is to provide a camming device that is always self-released yet applies a uniform tensioning force during sail unfurling to better control reefing operations.

Another object is to provide a tension control for a roller-reefing drum to obtain the orderly coiling and storage of the furling line thereon.

Another object is to provide a self-releasing cam that offers no resistance to furling operations.

These and still other objects and advantages will become more apparent hereinafter.

DESCRIPTION OF THE DRAWINGS

In the accompanying drawings, which form a part of this specification and wherein like numerals refer to like parts wherever they occur.

DESCRIPTION OF THE PREFERRED EMBODIMENT

Figure 1:
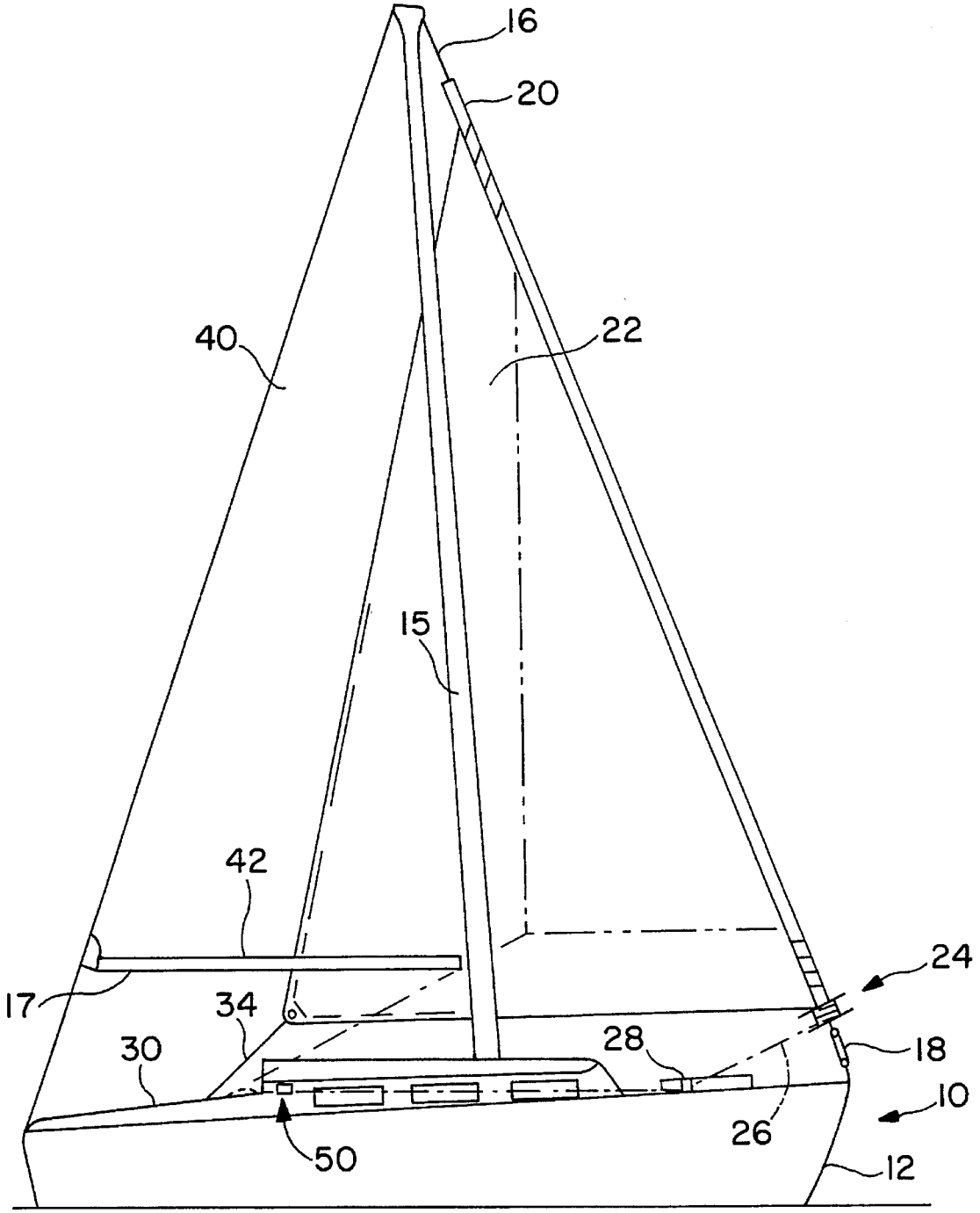
FIG. 1 is a diagrammatic side elevational view of a sailboat having a typical roller-reefing system controlled by the present invention.
Figure 2:
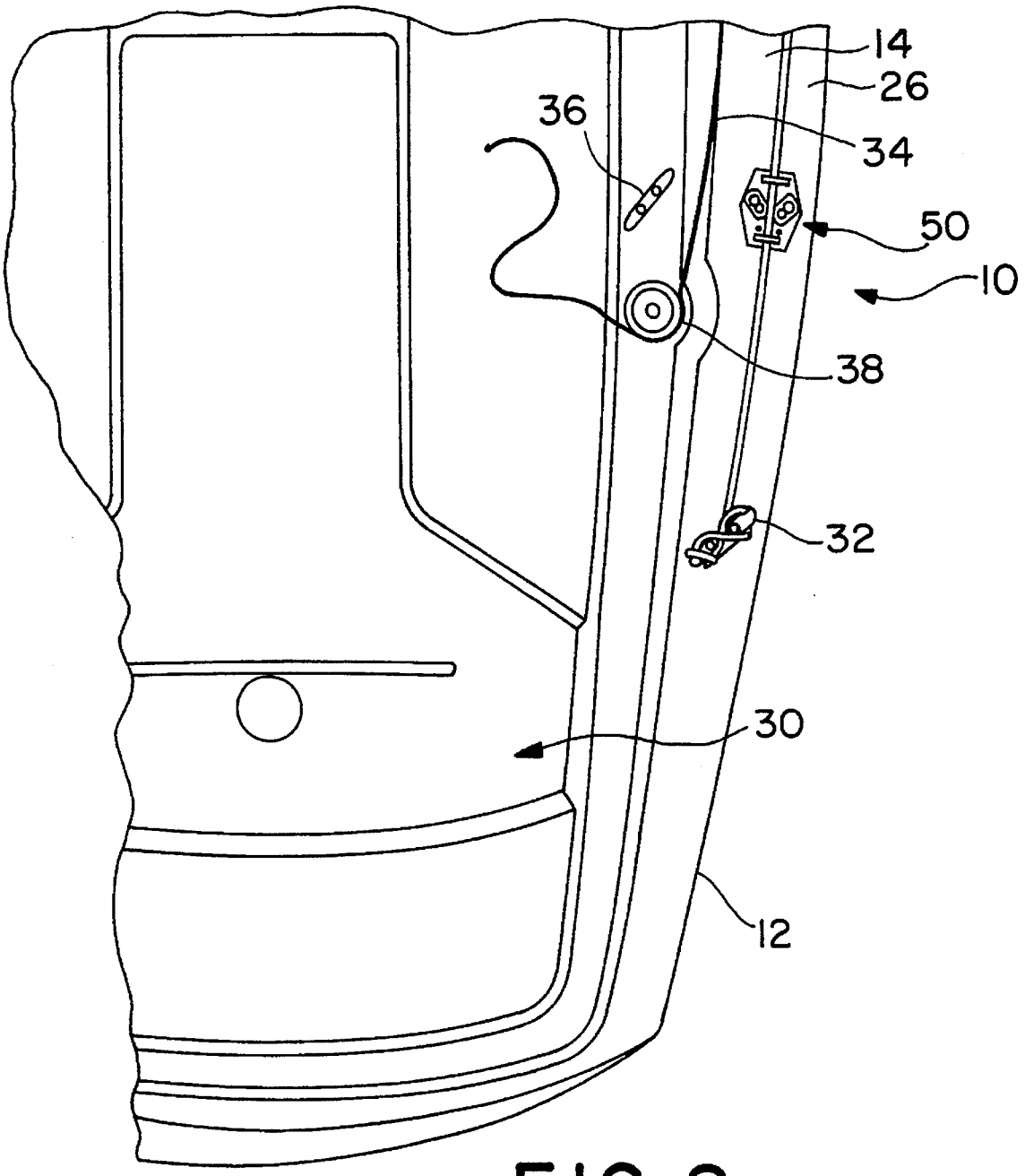
FIG. 2 is an enlarged fragmentary plan view of the cockpit area of a sailboat showing the present invention.

Referring to FIG. 1, a typical sailboat 10 comprises a hull 12, a deck 14, a vertical mast 15 extending upwardly from the deck 14, and a headstay 16 connected at one end with the bow end of the hull 12 through an anchoring member 18. The stay 16 extends slantwise from the bow end of the hull 12 toward the top of the mast 16 and is suitably connected to the top of the mast 15. Typically, a sail furling shaft 20 of hollow configuration is fitted over the stay 16, and is constructed and arranged with a longitudinal slot (not shown) to receive the luff or leading edge of a triangular sail 22, such as a jib, spinnaker or other foresail. The sail furling shaft 20 also includes a winding drum or spool 24 at the bottom end with a furling line 26 connected at one end to the drum 24. The furling line 26 extends from the drum 24 in a direction substantially perpendicular to the axis of the drum, usually through a fixed guide (not shown, but typically assembled with the drum) and thence through a further guide means or fairlead block 28 mounted on the deck 14. The furling line 26 then extends aft to the cockpit area 30 at the stern of the hull 12 where a cleat 32 is provided for securing the furling line 26 when the foresail 22 is rolled and stored in inoperative condition. Another line 34 (i.e. sheet line or jib line) is connected to the corner of the foresail 22 and extends into the cockpit 30 and is held in a position of adjustment by another cleat 36. A winch 38 is also shown adjacent to this cleat 36, and may be used to control reefing of a spinnaker (22) under running conditions. FIG. 1 also shows a main sail 40 carried on mast 15 and boom 42 in a usual manner.

When the furling line 26 is drawn aft into the cockpit 30, the winding drum 24 and the sail furling shaft 20 are rotated to wind up or furl the sail 22 therearound. The furling line can then be releasably secured on the cleat 32. Thus, when not sailing or during times that the foresail or headsail 22 is furled by being rolled on the shaft 20, the furling line 26 has been drawn aft and neatly stored and the drum 24 is empty. Under sailing conditions, the furling line 26 and headsail sheet 34 are uncleated, and the head sail sheet 34 is drawn aft to start the unwinding or unfurling action of the head-sheet 22. Usually the wind becomes a major factor and catches the sail to accelerate the unfurling action in which the shaft 20 and drum 24 are rotated to draw the furling line forward and coil it on the drum 24 as the sailor manually controls the sheet line 34 into the cockpit to set the sail as desired.

Figure 4:
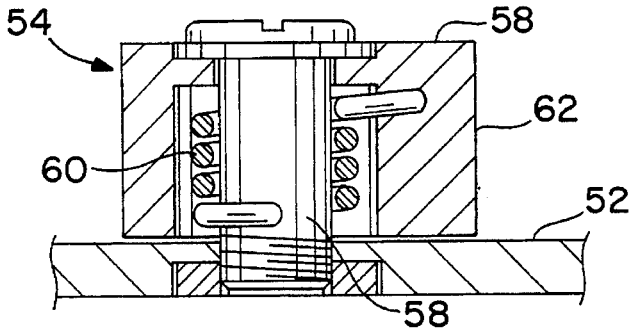
FIG. 4 is a partial cross-sectional view taken substantially along line 4—4 of FIG. 3.
Figure 5:
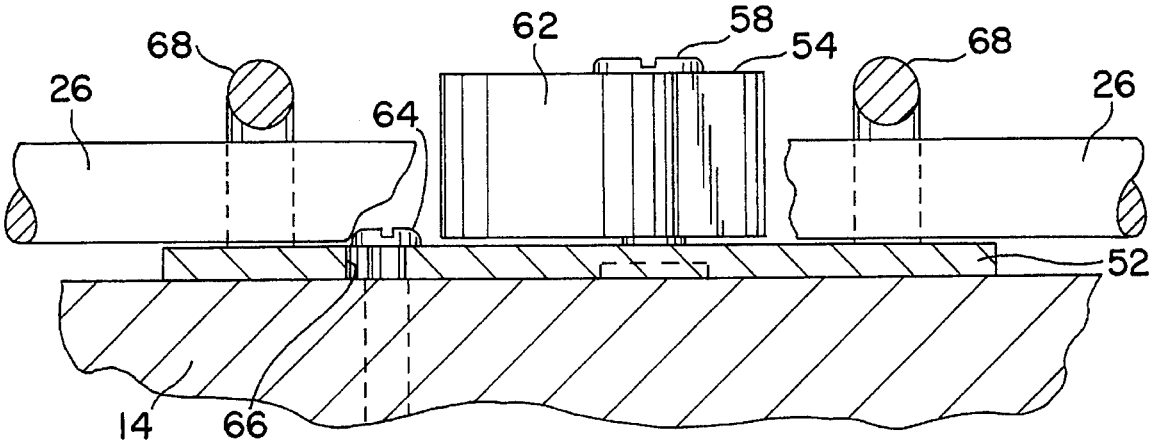
FIG. 5 is a partial cross-sectional view taken substantially along line 5—5 of FIG. 3.

The present invention is embodied in a tensioning device 50, in combination with a sail roller-reefing system, for applying a resistant force on the furling line 26 during rotation of the drum 24 and shaft 20 during unfurling action of the sail. The tensioning device 50 is in the nature of a pressure cam assembly having a substantially flat base member 52 on which a pair of mirror-image cam members 54 and 56 are pivotally mounted for limited rotation toward and away from each other. Referring to FIG. 4, it will be seen that each cam member (54) is suitably journaled on a post 58 secured to the base 52 and is biased by a spring 60 of predetermined tension or force to move its inner cam face 62 toward the center of the base plate. The general arrangement of spring-loaded cam members in line cleating devices is shown in U.S. Pat. Nos. 3,730,129; 3,750,611 and 4,217,847 and any such spring-biasing arrangement is acceptable. However, it is within the purview of the present invention to adjust the tension force of the spring 60, and thus the post 58 may be adjustably secured to the base 52 so that it can be tightened down to increase the spring force or loosened as desired. It will be readily apparent to those skilled in the art that various alternatives are available to carry out this objective, even as it will be apparent that other changes in the disclosed embodiment can be made, such as employing a single spring for only one of the cam members or that different spring forms can be used. It is also a feature of the invention is that the cam faces 62 be relatively smooth so that there is no locking or jamming action by the cam members on the rope or line 26, as will be discussed more fully.

Figure 3:
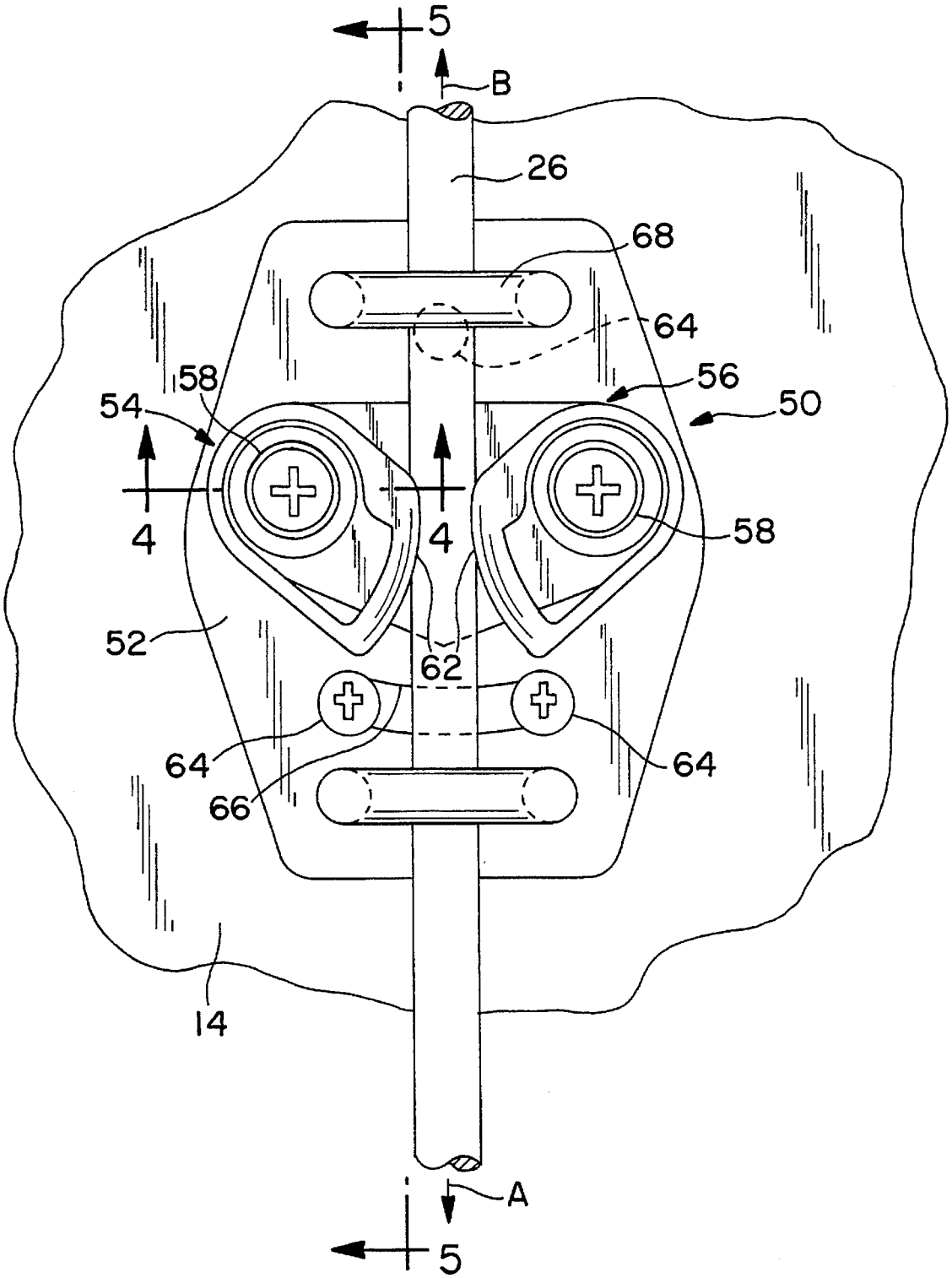
FIG. 3 is a greatly enlarged plan view of a line control device embodying the invention.

Referring to FIG. 3, the base plate 52 is secured to the deck 14 or other suitable location of the sailboat 10 by screws 64. One screw 64 is centrally positioned through the forward or leading side of the plate 52 in line with the run of the furling line 26 from the bow of the hull 12. The aft or trailing area of the base plate 52 is provided with a lateral slot 66 to receive at least one screw 64 for mounting the plate 52 to the deck 14, thus permitting angular adjustment of the plate 52 around the forward screw. A line guide or rope keeper hoop 68 is provided on the forward and aft sides of the base plate 52 to align the furling line 26 across the tensioning device and keep it contained between the cam faces 62 of the cams 54 and 56 at all times.

It has been stated that the cam faces 62 of the cam members 54 and 56 should be relatively smooth. The prior art cam cleat devices teach the use of cam faces having teeth that grip or jam into the ropes or lines to prevent movement in at least one direction, and such devices also may require a large force in the opposite direction to disengage the jaw teeth to permit the rope to be lifted up above the device for use. In the present invention there are no teeth and there is no gripping action so that sliding movement of the line 26 in opposite directions can take place. During furling action when the line 26 is drawn aft by the sailor to rotate the drum 24 and shaft 20 (direction A in FIG. 3), the cams 54 and 56 open up to permit the line 26 to slide freely on the cam faces 62. However, during unfurling and reefing operations when the headsail 22 is being unwound from the shaft 20, the rotation of the drum 24 coils up the furling line 26 (direction B in FIG. 3) and the spring tension of springs 60 bring the cam faces 62 to bear against the line 62 and resist its free movement so that drum rotation is retarded thereby to assist in smoother line coiling thereon on the drum. In either direction the line 26 is kept between the cam faces at all times by the guide hoops 68.

Figure 6:
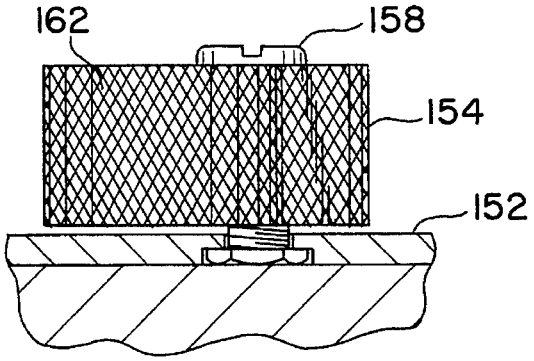
FIG. 6 is a fragmentary view, similar to FIG. 5, but showing another cam face embodiment.

Referring to FIG. 6, it will be seen that the effective drag or frictional force of the cams 154 and 156 upon the furling line (126) can be increased, but kept non-locking, by using an alternate cam face 162 that is knurled or otherwise slightly roughened. As stated, other modifications and arrangements will now become apparent to those skilled in the art on the basis of the foregoing disclosure.

What is claimed is:

1. A furling line tensioning device for controlling the coiling action of a roller-reefing drum, comprising a base adapted to be fastened to a sailboat mounting structure, first and second members on said base and having opposed cam walls defining a furling line receiving passageway therebetween, said cam walls being constructed and arranged to accommodate non-locking linear furling line movement in opposite directions, and at least one of said members being pivotally mounted on said base and spring-biased to move its cam surface toward a passage restricting position to pressurize said furling line between the opposed cam walls and resist furling line movement in only one direction.

2. The tensioning device of claim 1, wherein the spring-biasing force acting on said one member exerts a predetermined pressure to resist furling line movement in a first direction during sail unfurling operations.

3. The tensioning device of claim 1, in which the spring-biasing force acting on said one member exerts a negligible pressure on the furling line during sail furling movement in the opposite direction.

4. The tensioning device of claim 3, including other means for maintaining the furling line between the cam walls during its movement in both directions and at all times.

5. The tensioning device of claim 4, in which said other means comprises hoop means secured to the base in linear alignment with the passageway defined between the opposed cam walls.

6. The tensioning device of claim 1, including hoop means constructed and arranged to maintain the furling line in its passageway position between the cam walls at all times during furling and unfurling operations.

7. The tensioning device of claim 1, including means for adjusting the spring-biasing force on the one movable member.

8. The tensioning device of claim 1, in which both of said members are pivotally mounted on said base and are spring-biased to move the opposed cam walls thereof toward each other to exert pressure on the furling line therebetween.

9. The tensioning device of claim 8, including means for adjusting the spring-biasing force on both movable members.

10. The tensioning device of claim 8, in which the opposed surfaces of said cam walls are relatively smooth and accommodate non-locking sliding movement of the furling line in opposite directions.

11. The tensioning device of claim 8, including friction means constructed and arranged on the surface of at least one of said cam walls for increasing the frictional resistance of the members to movement of the furling line during unfurling operations.

12. The tensioning device of claim 11, in which said friction means comprises a roughened cam surface on the one cam member wall.

13. The tensioning device of claim 11, in which said friction means is provided on both opposed cam walls.

14. A furling line tensioning device for controlling the coiling action of a furling line on a roller-reefing drum, comprising a pressure cam assembly having base means for mounting to a sailboat structure, first and second cam members constructed and arranged with opposed cam walls extending normal to said base means and forming a passageway for a furling line therebetween, at least one of said cam members being pivotally mounted on said base means and having spring-loaded means for biasing its cam surface toward a closed position with the opposed cam member for providing a tensioning force on a furling line within the passageway during unfurling operations while accommodating substantially unrestricted passage of the furling line during furling operations.

15. The tensioning device of claim 14, in which said spring-loaded means is adjustable to vary the tensioning force exerted on the furling line.

16. The tensioning device of claim 14, including friction means constructed and arranged on at least one cam wall for increasing the frictional resistance exerted between the cam members over the tensioning force of said spring-loaded means during unfurling operations.

17. The tensioning device of claim 14, including furling line keeper means constructed and arranged on said base means for maintaining the furling line in position between the opposed cam walls at all times.

18. A furling line tensioning device for controlling the coiling action of a furling line on a roller-reefing drum, comprising base means for mounting said device to a sailboat structure including means for angularly adjusting said base means on the sailboat structure, a pair of mirror-image cam members constructed and arranged with opposed cam walls having relatively smooth cam surfaces defining a furling line passageway therebetween, said angularly adjustable means of said base means accommodating orientation of said passageway for linear furling line movement through said device in opposite directions, said cam members being pivotally mounted on said base means and having spring-loaded means for biasing the cam surfaces toward each other to apply a tensioning force on the furling line in one direction of movement and accommodating unrestricted furling line movement in the opposite direction, and keeper means constructed and arranged on said base means for maintaining the furling line in the passageway between the opposed cam walls at all times.

* * * * *